United States Patent [19]

Yoshino et al.

[11] Patent Number: 4,944,031

[45] Date of Patent: Jul. 24, 1990

[54] OPERATIONAL CONDITION SETTING DEVICE FOR AN OFFICE MACHINE

[75] Inventors: Hirobumi Yoshino, Tokyo; Takashige Ito, Yokohama; Junichi Kawase, Kawasaki; Hiroyuki Maeda, Yokohama, all of Japan

[73] Assignee: Ricoh Company, Ltd., Tokyo, Japan

[21] Appl. No.: 329,805

[22] Filed: Mar. 28, 1989

[30] Foreign Application Priority Data

| | | | |
|---|---|---|---|
| Mar. 29, 1988 | [JP] | Japan | 63-75262 |
| Mar. 29, 1988 | [JP] | Japan | 63-75263 |
| Mar. 29, 1988 | [JP] | Japan | 63-75265 |

[51] Int. Cl.[5] ..... G03G 15/00

[52] U.S. Cl. ..... 355/206; 355/208

[58] Field of Search ..... 355/204, 206, 208, 314; 364/900

[56] References Cited

U.S. PATENT DOCUMENTS

| | | | |
|---|---|---|---|
| 3,982,832 | 9/1976 | Bendall et al. | 355/221 X |
| 4,310,235 | 1/1982 | Lorenzo et al. | 355/314 |
| 4,479,194 | 10/1984 | Fogg et al. | 364/900 |
| 4,609,283 | 9/1986 | Murata et al. | 355/208 |

*Primary Examiner*—L. T. Hix

*Assistant Examiner*—D. Rutledge

*Attorney, Agent, or Firm*—Oblon, Spivak, McClelland, Maier & Neustadt

[57] ABSTRACT

An apparatus for use with an office machine for allowing operational conditions of the machine to be set up with ease and promoting easy handling of a menu sheet on which information for selecting the operational conditions are to be written. An operator can condition the machine for desired operation modes simply by marking a menu sheet and then inserting it in a menu sheet reader. Even when the menu sheet jams a transport path defined in the menu sheet reader, for example, it can be dealt with by simple processing.

15 Claims, 20 Drawing Sheets

MOTOR DRIVE CONTROL

IDENTIFICATION OF POSITION & DIRECTION OF MENU SHEET

READING MARK ON MENU SHEET

IDENTIFICATION OF ID CODE
ON MENU SHEET

MARKING ERROR CHECK

ERROR PROCESSING

MARK OMISSION

AUTO START

USER MANAGEMENT

MANAGEMENT DATA OUTPUT

OPERATIONAL CONDITION SETTING DEVICE FOR AN OFFICE MACHINE

BACKGROUND OF THE INVENTION

The present invention generally relates to an electrophotographic copier, printer, facsimile apparatus or similar office machine having various functions and, more particularly, to an apparatus for use with such an office machine for setting desired operational conditions of the machine.

A modern office machine of the kind described, especially an electrophotographic copier, is furnished with a variety of functions. This kind of copier, for example, has an operation board on which a number of key switches and displays are arranged to be accessible for selecting operational conditions or modes associated with the respective functions of the copier. An operator therefor has to be well informed of the functions of all of the key switches on the operation board. In addition, every time the operator uses the copier, the operator has to see all of the various displays on the operation board one by one to confirm whether or not desired operation modes have been set up. This forces the operator to perform troublesome manipulations even when the desired operation modes are comparatively simple modes. Although an exclusive skilled operator may be stationed at the copier at all times, it is extremely difficult for a person to show the operator the desired operation modes for copying exactly.

In the light of this, it has been proposed to implement the setting of operational conditions by an IC (Integrated Circuit) card. A drawback with the IC card scheme is that writing various kinds of information for selecting operation modes in an IC card is not easy and, moreover, the information written on an IC card cannot be seen unless a special display is used. It has also been proposed to automatically set up desired operation modes of a copier by use of a mark sheet or menu sheet and a sheet reader. Specifically, visible information in the form of marks, for example, are written on the sheet for specifying desired operation modes, and the sheet is read by the sheet reader which is mounted on the copier body so as to automatically condition the copier for the desired operation modes. This kind of scheme is successful in eliminating the problems of the IC card. The sheet carrying specified mode information thereon is loaded in an automatic document feeder (ADF) and, like an ordinary document, transported by the ADF on and along a glass platen of the copier in response to a copy start command. While the sheet is so transported by the ADF, the information on the sheet is read by the sheet reader to automatically set up particular operation modes as indicated by the information. Alternatively, the sheet may be laid on the glass platen and read by the sheet reader which is mounted on a movable scanner, for example, disposed below the glass platen. Hence, the menu sheet and sheet reader scheme allows mode information to be written with ease and allows the written information to be readily confirmed without resorting to any special display.

However, the sheet reader stated above is securely built in the copier body so that the whole copier is complicated in construction and therefore needs an extra cost. Moreover, for those users who do not need or rarely need the automatic mode setting function implemented by the sheet and built-in sheet reader, purchasing a more expensive copier and do not make use of such a special function and therefor this is wasteful.

To overcome the above problem, the sheet reader may be constructed into an optional unit which is removable from the copier body as desired, as also proposed in the art. However, the prior art approach of this kind has some problems left unsolved. For example, while the sheet on which information are written down is read by the sheet reader, it may cause a transport error to occur inside the card reader. Specifically, when the sheet is caught by any projection existing in the sheet reader due to its own curl or similar deformation, it jams the transport path defined in the sheet reader. It is extremely difficult to remove such a sheet which is far smaller than sheet reader from the sheet reader. Further, when the sheet is inserted in the sheet reader upside down or in a wrong direction, the information written thereon cannot be correctly read and the sheet transport is apt to fail. This kind of sheet therefore requires careful handling which would further trouble the operator.

When the operation modes are selected by using such a sheet, errors are often introduced in the mode setting. Specifically, while a copier is controlled to prevent two or more different modes which are associated with a single functional item or modes which are not available with the copier from being entered on its operation board or the like, the prior art sheet discussed above is not provided with means for correcting erroneous mode setting information which may be written therein. Should a person write mode setting information in a wrong column, a plurality of different operation modes might be entered together for the same functional item available with the copier.

SUMMARY OF THE INVENTION

It is therefore an object of the present invention to provide an operational condition setting apparatus for use with an office machine which promotes easy setting of operational conditions of the machine and allows a menu sheet for writing information associated with the operational conditions to be handled with ease.

It is another object of the present invention to provide an operational condition setting apparatus for use with an office machine which prevents the machine from operating in an unexpected manner even when operation modes are specified in an unusual manner.

It is another object of the present invention to provide a generally improved operational condition setting apparatus for an office machine.

An apparatus for setting operational conditions of an office machine which performs a recording operation by using a menu sheet having a predetermined format and provided with an area for writing information of the present invention comprises a reading device for reading the information written in the area of the menu sheet, and a mode setting device for setting operational modes of the office machine on the basis of the information read by the reading device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
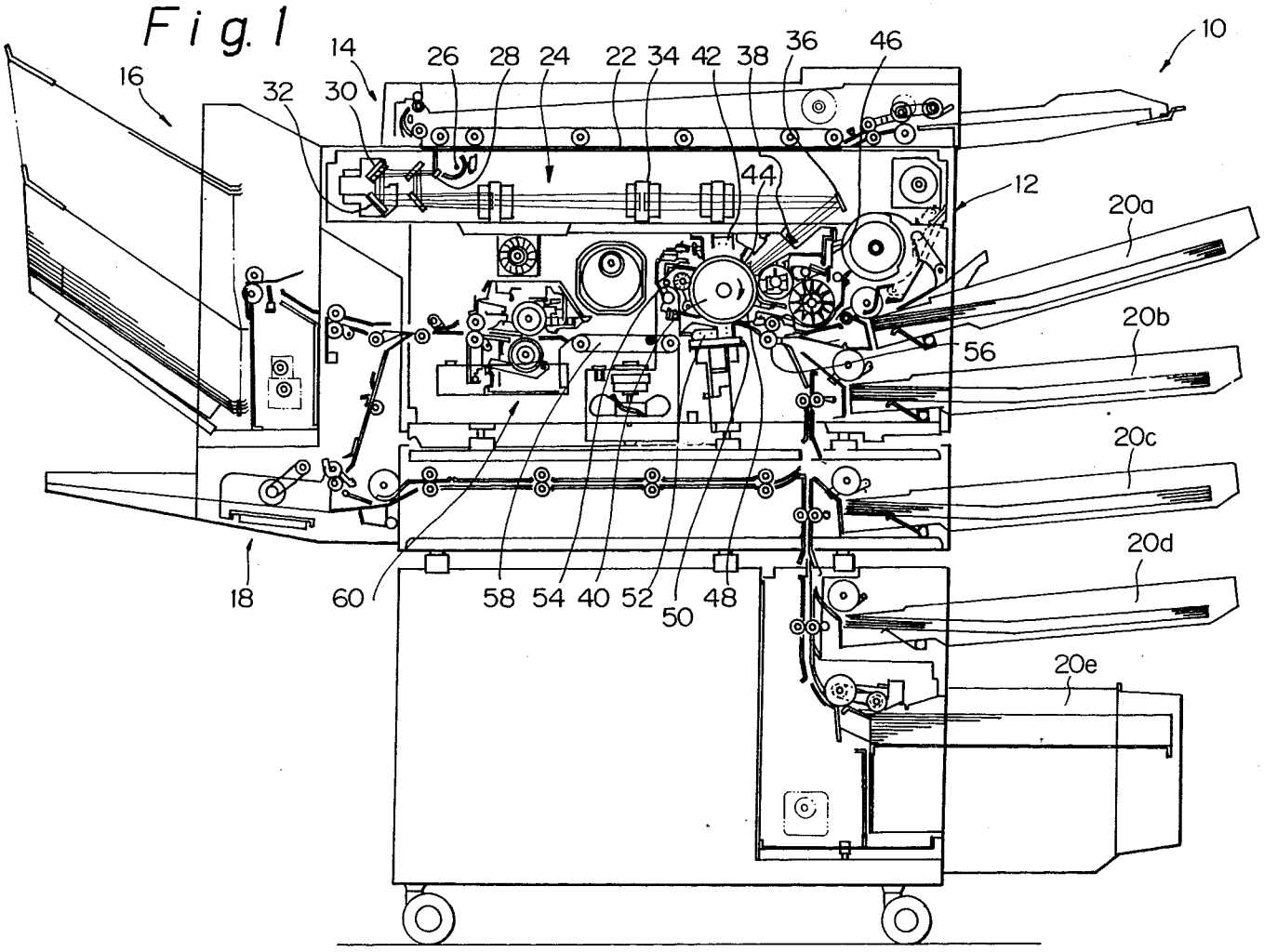
FIG. 1 is a sectional side elevation of a copier belonging to a family of office machines to which an operational condition setting apparatus of the present invention is applicable.

Referring to FIG. 1 of the drawings, a copier belonging to a family of office machines and to which a preferred embodiment of the present invention is applied is shown. The copier, generally 10, is generally made up of a body 12, an automatic document feeder (ADF) 14, a sorter 16, and a group of optional units such as an automatic two-side processing unit 18. The copier 10 is provided with five paper feed stages, i.e., a first and a second paper feed stage 20*a* and 20*b* which are constructed into a first paper feed unit, a third paper feed stage 20*c* configured as a second paper feed unit, and a fourth and fifth paper feed stage 20*d* and 20*e* constructed into a third paper feed unit. The first paper feed unit is mounted on the copier body 12, while the second and third paper feed units are operatively connected to the copier body 12. The first to fourth paper feed stages 20*a* to 20*d* each are implemented as a cassette, and the fifth paper feed stage 20*e* is implemented as a tray.

A glass platen 22 is provided on the top of the copier body 12 for laying an original document thereon. Disposed below the glass platen 22 is an optical scanning system 24 which includes a lamp 26, a first mirror 28, a third mirror 30, a fourth mirror 32, a lens 34, a fifth mirror 36, and a slit 38. The lamp 26 and first mirror 28 are mounted on a first carriage, while the third and fourth mirrors 30 and 32 are mounted on a second carriage. While the scanning system or optics 24 scans a document on the glass platen 22, the first and second carriages are mechanically driven at a relative speed of 2:1 in order to prevent the length of the optical path from being changed. Comprising a zoom lens, the lens 34 may be driven by a motor to change the magnification. Light issuing from the lamp 26 is routed through the first mirror 28, third mirror 30, fourth mirror 32, lens 34, fifth mirror 36 and slit 38 to be focused on a photoconductive drum 40. Arranged around the drum 40 are a main charger 42, an eraser 44, a developing unit 46, a pretransfer discharge lamp 48, a transfer charger 50, a separation charger 52, a cleaning unit 54, etc.

The copier 10 reproduces an image by a procedure which will be outlined hereinafter. The surface of the drum 40 is uniformly charged by the main charger 42 to a predetermined high voltage. The charge deposited in those portions of the drum 40 which are not used for the reproduction is erased by the eraser 44. As the charged surface of the drum 40 is exposed imagewise to a reflection from the document, the potential of that surface changes (decreases) in association with the intensity of the incident light. While the drum 40 is rotated as indicated by an arrow in the figure, the optics 24 sequentially scans the surface of the document in synchronism with the rotation of the drum 40. As a result, an electrostatic latent image is formed on the drum 40 in the form of a potential distribution which is associated with the density (reflectance) of the document image. When the area of the drum surface where the latent image has been formed reaches the developing unit 46, a toner stored in the developing unit 46 adheres to the drum surface in association with the potential distribution to thereby transform the latent image to a toner image. While the copying process proceeds, a paper sheet is fed from one of the five paper feed stages 20*a* to 20*e*. At a predetermined timing, the paper sheet is driven toward the drum 40 by a register roller 56. The toner image on the drum 40 is transferred to the paper sheet by the transfer charger 50, and then the paper sheet carrying the toner image thereon is separated from the drum 40 by the separation charger 52. The separated paper sheet is conveyed by a transport belt 58 to a fixing unit 60 so that the toner image is fixed on the paper sheet by heat. Then, the paper sheet is transported along a predetermined discharge path to reach the sorter 16 or the automatic two-side unit 18.

Figure 2A:
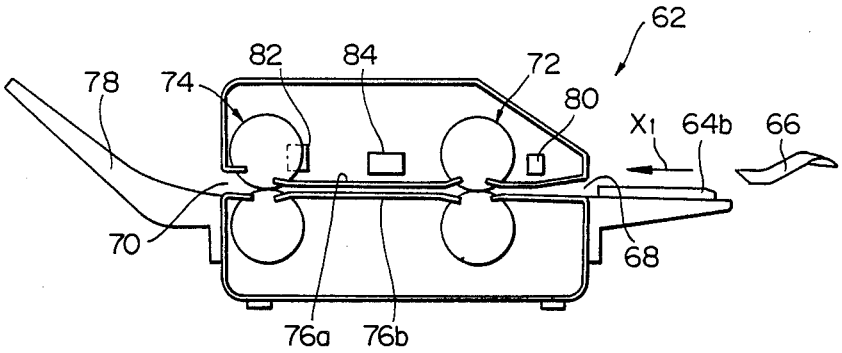
FIGS. 2A and 2B show in a vertical section and a side elevation, respectively, a menu reader as viewed from the front and from the side.
Figure 2B:
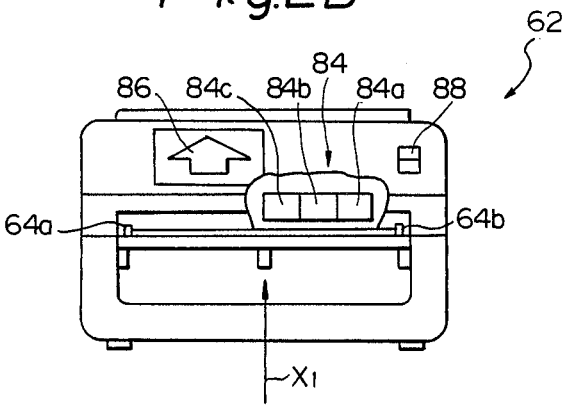

In FIGS. 2A and 2B, there is shown a sheet reader in the form of a menu sheet reader 62 which is connected to the copier 10 for reading various copier operation modes written on a menu sheet. As shown, the menu sheet reader 62 is provided with guide members 64*a* and 64*b* at its right end as viewed in FIG. 2A. A menu sheet 66 is inserted in a slot or inlet 68 of the reader 62 in a direction indicated by an arrow $X_1$, while being guided by the guide members 64*a* and 64*b*. Transport roller pairs 72 and 74 are located in the vicinity of the slot 68 and another slot or outlet 70, respectively. Driven by an electric motor 218 which will be described, the transport roller pairs 72 and 74 cooperate to move the menu sheet from the inlet 68 to the outlet 70 along a path which is defined by a pair of guide plates 76*a* and 76*b*. The menu sheet 66 reached the outlet 70 is driven out of the reader 62 onto a tray 78. An inlet sensor 80 is disposed slightly upstream of the roller pair 72 and responsive to the insertion of the menu sheet 66. An outlet sensor 82 is located slightly upstream of the other roller pair 74 for sensing the discharge of the menu sheet 66 toward the tray 78. A sheet sensing unit 84 is situated between the roller pairs 72 and 74 and made up of three sheet read sensors 84*a*, 84*b* and 84*c* which are arranged side by side in a direction perpendicular to the sheet transport direction $X_1$. The reader 62 is further provided with an arrow-shaped indicator 86 having an LED built therein as will be described, and an exclusive power switch 88. While the menu sheet reader 62 reads information which are written on the menu sheet 66 and transmits them to the copier body 12, the copier body 12 selects various operation modes based on those information.

Figure 3B:
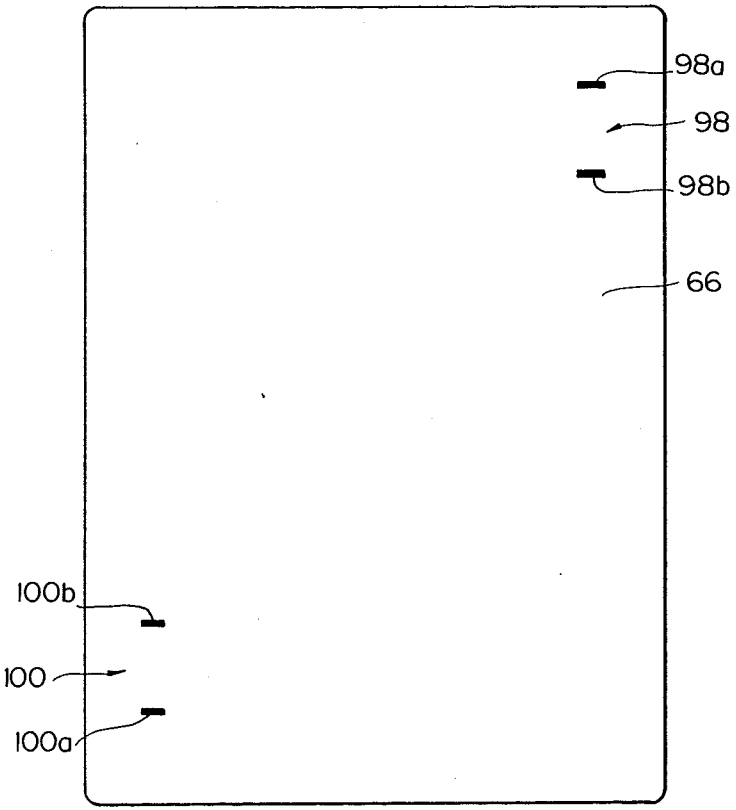
FIGS. 3A and 3B are views showing respectively the front and the back of a menu sheet.
Figure 3A:
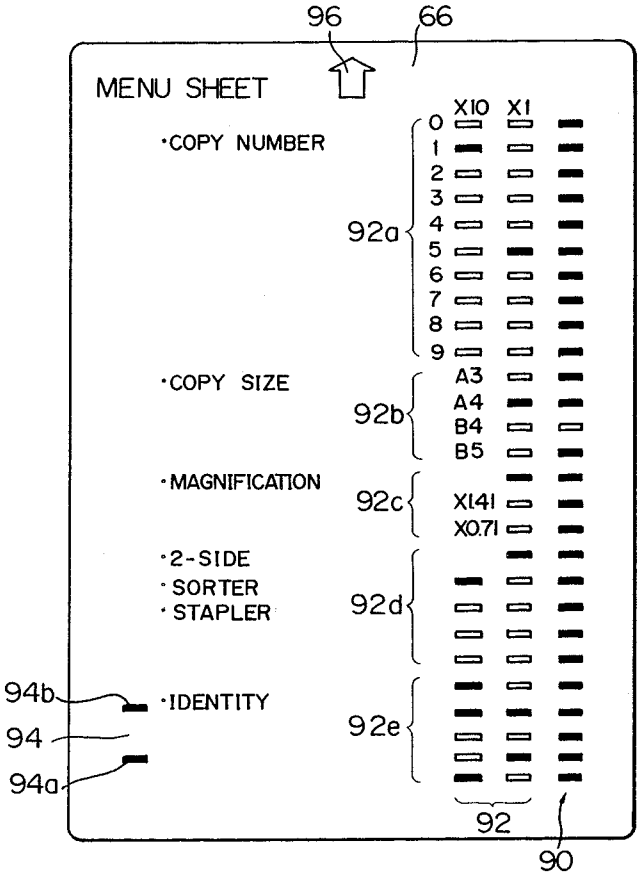

FIGS. 3A and 3B show respectively the front and the back of an example of the menu sheet 66. As shown in FIG. 3A, a number of rectangular marks of the same shape are provided at equal intervals on the right-hand side of the front of the menu sheet 66. The rightmost marks on the menu sheet 66 are timing marks 90 all of which are smeared in black. Provided at the left of the timing marks 90 are data marks 92 some of them are left blank and the others are smeared. Before use, all the data marks 92 on the menu sheet 66 are blank. One who intends to use the copier 10 selects desired copy modes by smearing any of the blank marks associated with the desired modes, thereby writing information on the menu sheet 66. In this particular example, the data marks 92 on the menu sheet 66 are divided into a copy number setting region **92*a*, a copy size setting region 92*b*, a magnification setting region 92*c*, an optional unit setting region 92*d*, and an identity setting region 92*e***.

The copy number setting region **92*a* has ten marks individually representative of the numbers "0" to "9" of the units digit, and ten marks individually representative of the numbers "0" to "1" of the tens digit. With this setting region or column 92*a*, therefore, it is possible to indicate the numbers of copies of zero to ninety-nine as desired. In FIG. 3A, fifteen copies is selected by way of example. The copy size setting region 92*b* has marks each being associated with respective one of four different paper sizes, i.e. A3, A4, B4 and B5; in FIG. 3A, the mark representative of size A4 is smeared to select size A4. In the magnification setting region 92*c*, marks individually representative of 1 magnification (100%), 1.41 magnification and 0.71 magnification are provided; 1 magnification is shown as being selected. The optional unit setting section 92*d* has a single mark for enabling or disabling a two-sided copying function, two marks for designating a mode of a sorter function, two marks for designating a mode of a stapler function, and four spare marks. Having ten marks in total, the identify setting region 92*e* is adapted to enter code information which shows whether or not a person intending to use the copier 10 is an authorized person. In this example, this region 92*e*** is capable of rendering a 10-bit identification code.

Direction identification marks 94 are provided at the lower left of the menu sheet 66 in the form of two smeared marks **94*a* and 94*b*, allowing the menu sheet reader 62 to automatically identify a direction in which the menu sheet 66 is inserted in the reader 62. Specifically, when the menu sheet 66 is to be read by the reader 62, it is necessary that the sheet 66 be inserted in the reader 62 in the direction which is indicated by an arrow mark 96. An operator, however, may inadvertently insert it in the opposite orientation. In this example, the direction identification marks 94*a* and 94*b* are positioned such that when the menu sheet 66 is turned 180 degrees from the expected orientation, the mark 94*a* replaces the uppermost timing mark 90 of FIG. 3A. The distance between the direction identification marks 94*a* and 94*b* is two times greater than the distance between the nearby timing marks 90. A control system built in the menu sheet reader 62 discriminates the timing marks 90 and the direction identification marks 94 by determining the pitch of signals associated with the timing marks 90, as described in detail later. Further, as shown in FIG. 3B, two groups of front/back identification marks 98 and 100 are provided on the back of the menu sheet 66 and constituted respectively by a pair of smeared marks 98*a* and 98*b* and a pair of smeared marks 100*a* and 100*b*, so that the reader 62 may distinguish the front and the back of the menu sheet 66 automatically from each other. When the menu sheet 66 is turned over, the marks 98 and 100 coincide with the timing marks 90 and the direction identification marks 94, respectively. In this example, the distance between the marks 98*a* and 98*b* and the distance between the marks 100*a* and 100*b* are each selected to be three times greater than the distance between the nearby timing marks 90. This allows the control system to see whether the menu sheet 66** is inserted in the expected direction and whether it is inserted face up.

Figure 4:
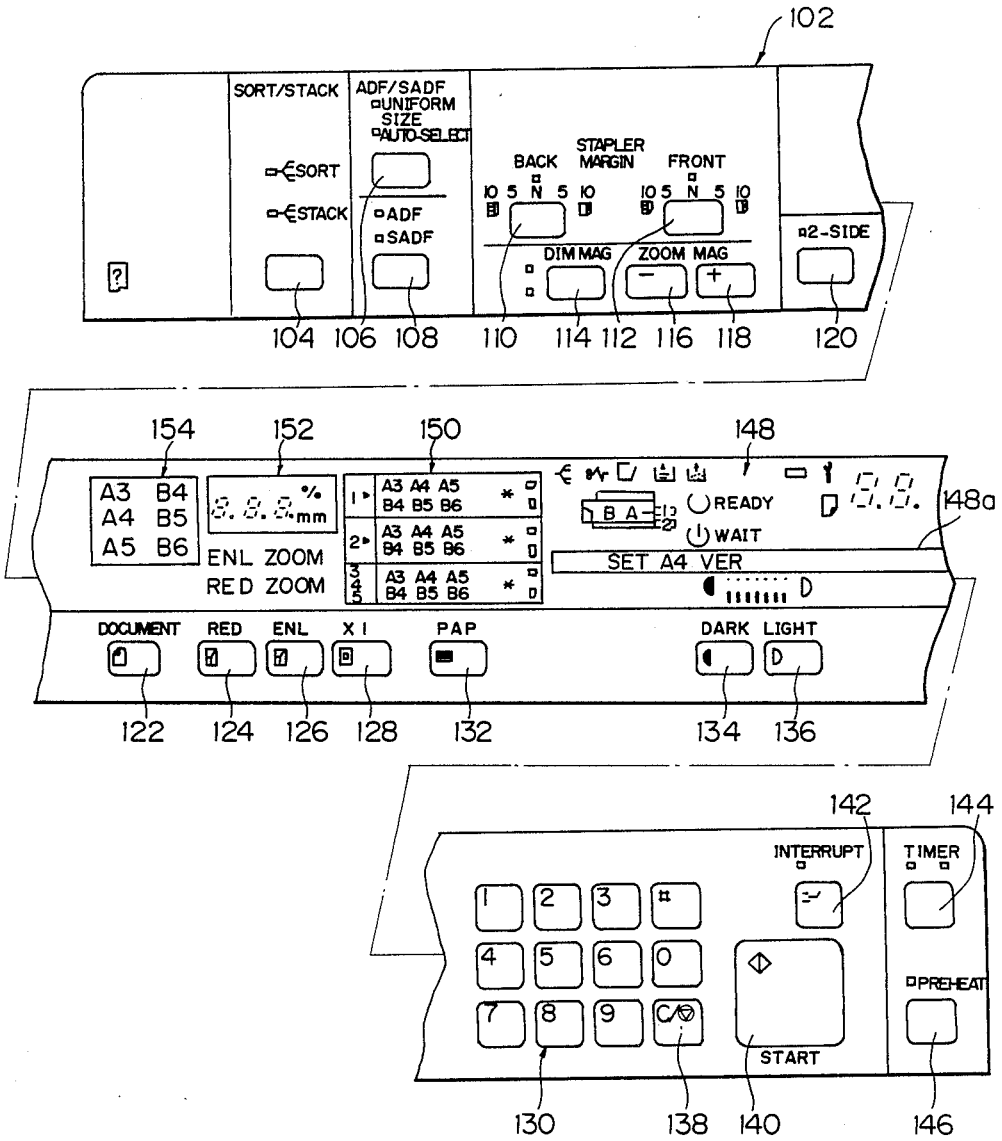
FIG. 4 is a view of an operation board which is mounted on the copier.

Referring to FIG. 4, an operation board provided on the copier 12 is shown and includes a number of key switches and a number of displays and indicators. The key switches include a sorter mode key 104, ADF-/SADF (semi-ADF) mode keys 106 and 108, staple margin keys 110 and 112, a size magnify key 114, zoom magnify keys 116 and 118, a two-sided mode key 120, a document size key 122, copy magnification adjust keys 124, 126 and 128, numeral keys 130, a paper select (paper feed stage switchover) key 132, density keys 134 and 136, a clear key 138, a print start key 140, an interrupt key 142, a timer key 144, and a preheat key 146. The displays and indicators include a display section 148 having a READY indicator, a message display, a density indicator and so on, a display section 150 having paper size indicators, a display section 152 having a magnification display, and a display section 154 having a document size display. If one intends to operate the copier 10 without using the menu sheet 66 and menu sheet reader 62, it is necessary to manipulate the numerous keys and displays on the operation board one after another, often resulting in mismanipulations.

Figure 5:
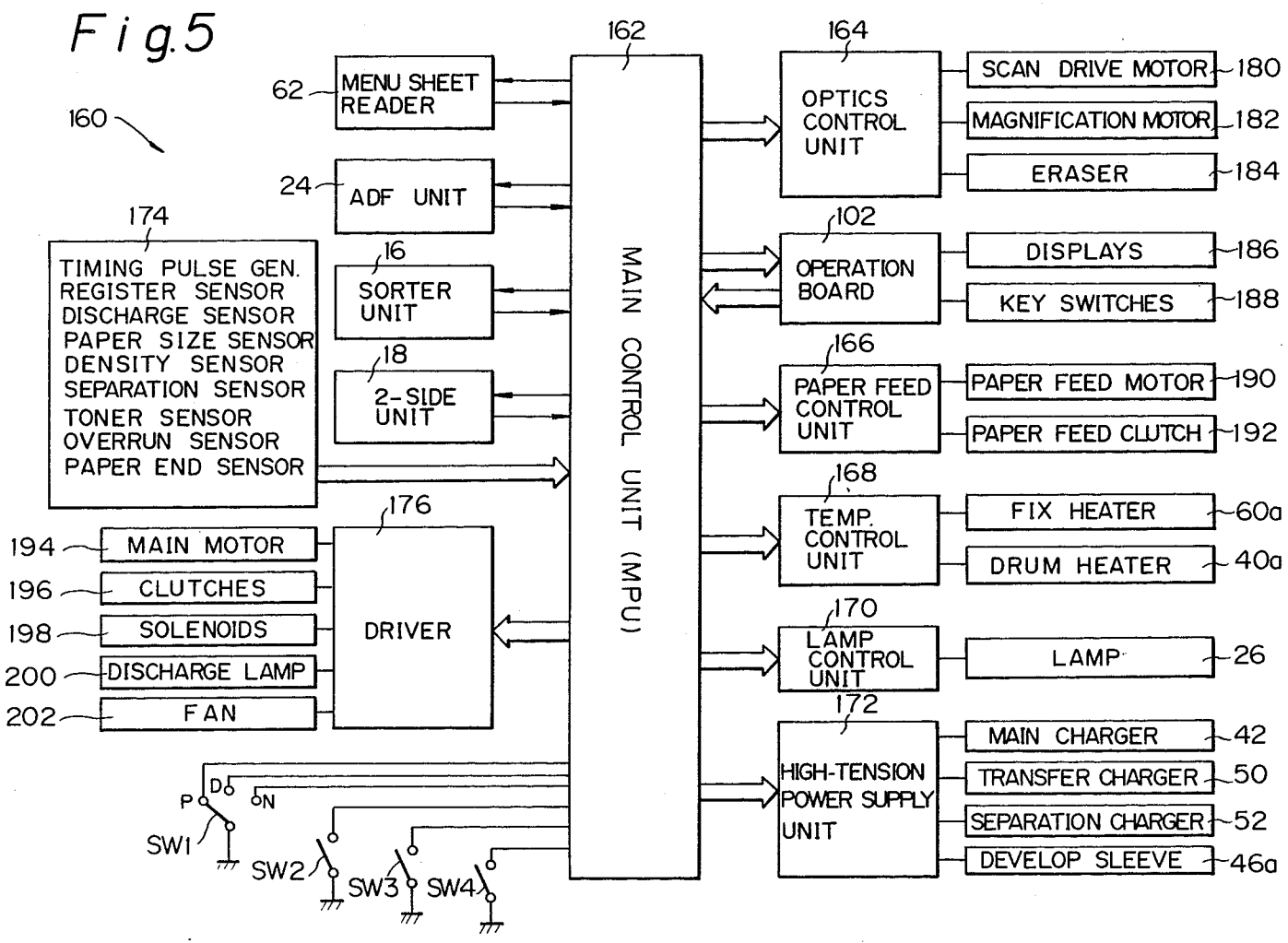
FIG. 5 is a schematic block diagram showing a control system which is installed in the copier of FIG. 1.

Referring to FIG. 5, a control system 160 for governing the operations of the entire copier 10 is shown and includes a main control unit 162 which in turn includes a microcomputer. Connected to the main control unit 162 are an optics control unit 164, the operation board 102, a paper feed control unit 166, a temperature control unit 168, a lamp control unit 170, a high-tension power supply unit 172, the ADF unit 24, a sensor unit 174, a driver 176, the sorter unit 16, the two-side unit 18, and the menu sheet reader 62.

Briefly, a scanning motor 180 for driving the optics 24, a magnification motor for adjusting the magnification, and an eraser 184 are connected to the optics control unit 164. Connected to the operation board 102 are displays 186 and key switches 188. Connected to the paper feed control unit 166 are a paper feed motor 190 and a paper feed clutch 192. Connected to the temperature control unit 168 are a fixing heater **60*a* and a drum heater 40*a*. The lamp 26 is connected to the lamp control unit 170, while the chargers 42, 50 and 52 and a developing sleeve 46*a* are connected to the high-tension power supply unit 172. The ADF unit 24 has a function of reading the size of a document while transporting it toward the glass platen 12 of the copier 10. The sensor unit 174 includes a timing pulse generator, a register sensor, a paper discharge sensor, a paper size sensor, a density sensor, a separation sensor, a toner sensor, an overrun sensor, and a paper end sensor. The paper size sensor is provided for each of the five paper feed stages 20*a* to 20*e* to sense the size of paper sheets which are loaded in the associated cassette. Connected to the driver 176 are a main motor 194, clutches 196, solenoids 198, a discharge lamp 200, and a fan 202. Switches SW1, SW2, SW3 and SW4 are also connected to the main control unit 162. Disposed in the copier 10**, the switches SW1 to SW4 are accessible for switching over various operations modes as desired, as discussed in detail later.

Figure 6:
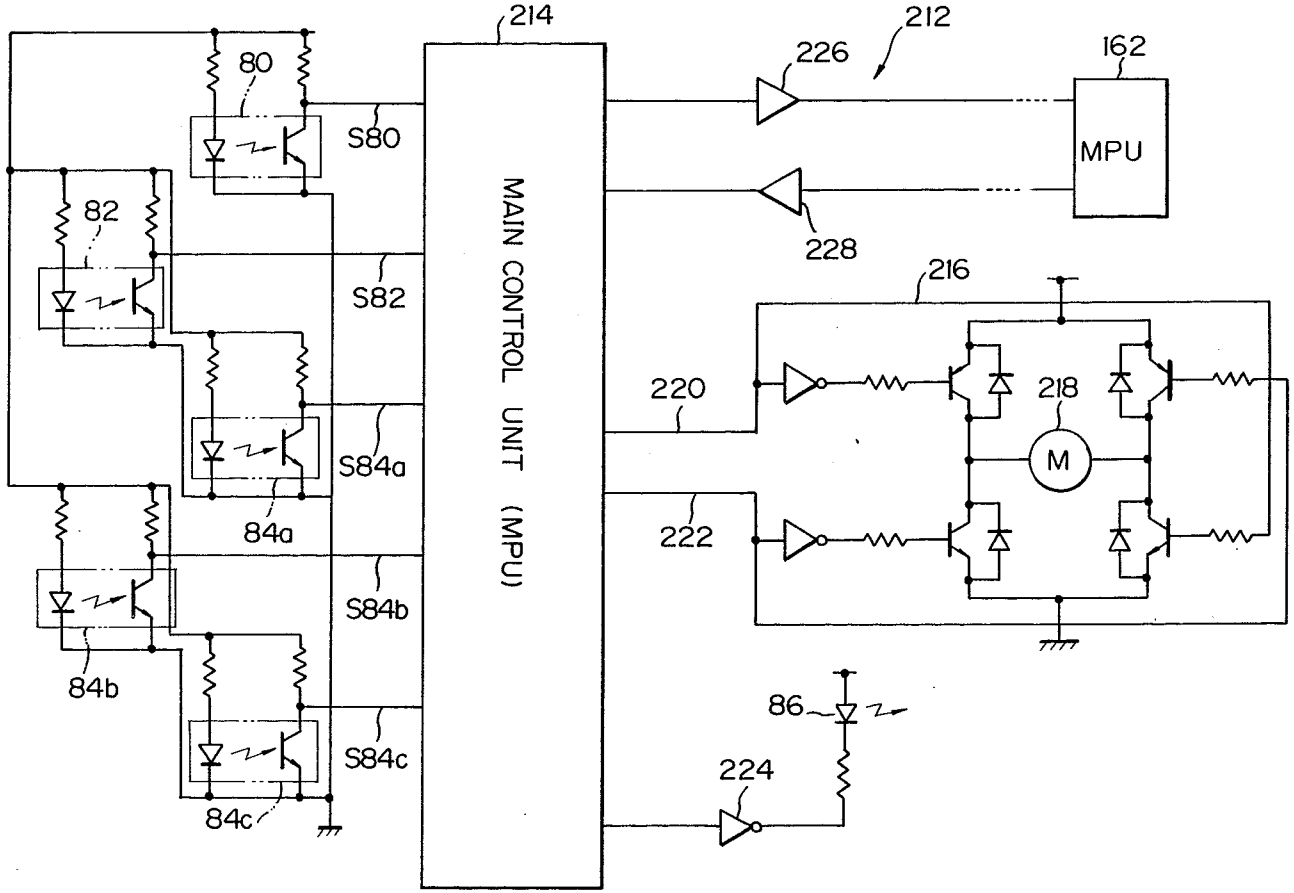
FIG. 6 is a circuit diagram schematically showing a control system built in the menu reader which is shown in FIGS. 2A and 2B.

Referring to FIG. 6, electric circuitry of a control system 212 installed in the menu sheet reader 62 is shown. As shown, the control system 212 has a microcomputer (MPU) 214. The microcomputer 214 has input ports connecting to five transmission type optical sensors which correspond respectively to the sensors 80, 82, 82*a*, 82*b* and 82*c* shown in FIGS. 2A and 2B. A roller drive motor 218 for driving the transport roller pairs 72 and 74 is connected to an output port of the microcomputer 214 via a motor driver 216. More specifically, two signal lines 220 and 222 are connected to an output port of the microcomputer 214. Signals for individually rotating the motor 218 in a clockwise direction and a counterclockwise direction are fed over the signal lines 220 and 222 to the motor driver 216. These signals are controllably fed to the motor driver 216 to selectively energize and deenergize the motor 218 while switching over the direction of current. The microcomputer 214 therefore can control the ON/OFF and driving direction of the motor 218. The LED 86 is connected to another output port of the microcomputer 214 via an inverter 224. The microcomputer 214 has a serial communication (data transmission) function and has a data transmit terminal and a data receive terminal connecting to serial communication terminals of the main control unit 162 of FIG. 5 via buffers 226 and 228, respectively. In this configuration, the menu sheet reader 62 and the main control unit 162 are capable of interchanging data with each other.

Figure 7:
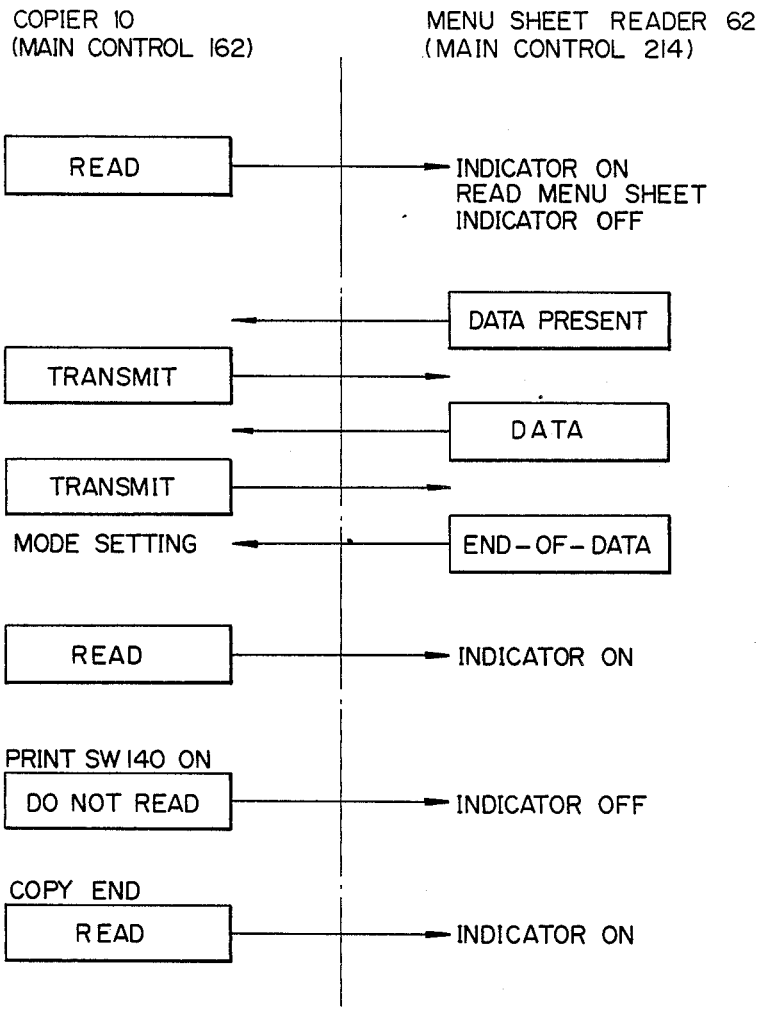
FIG. 7 shows how a main control unit of the copier of FIG. 1 and a main control unit of the menu reader of FIGS. 2A, 2B and 6 communicate with each other.
Figure 8:
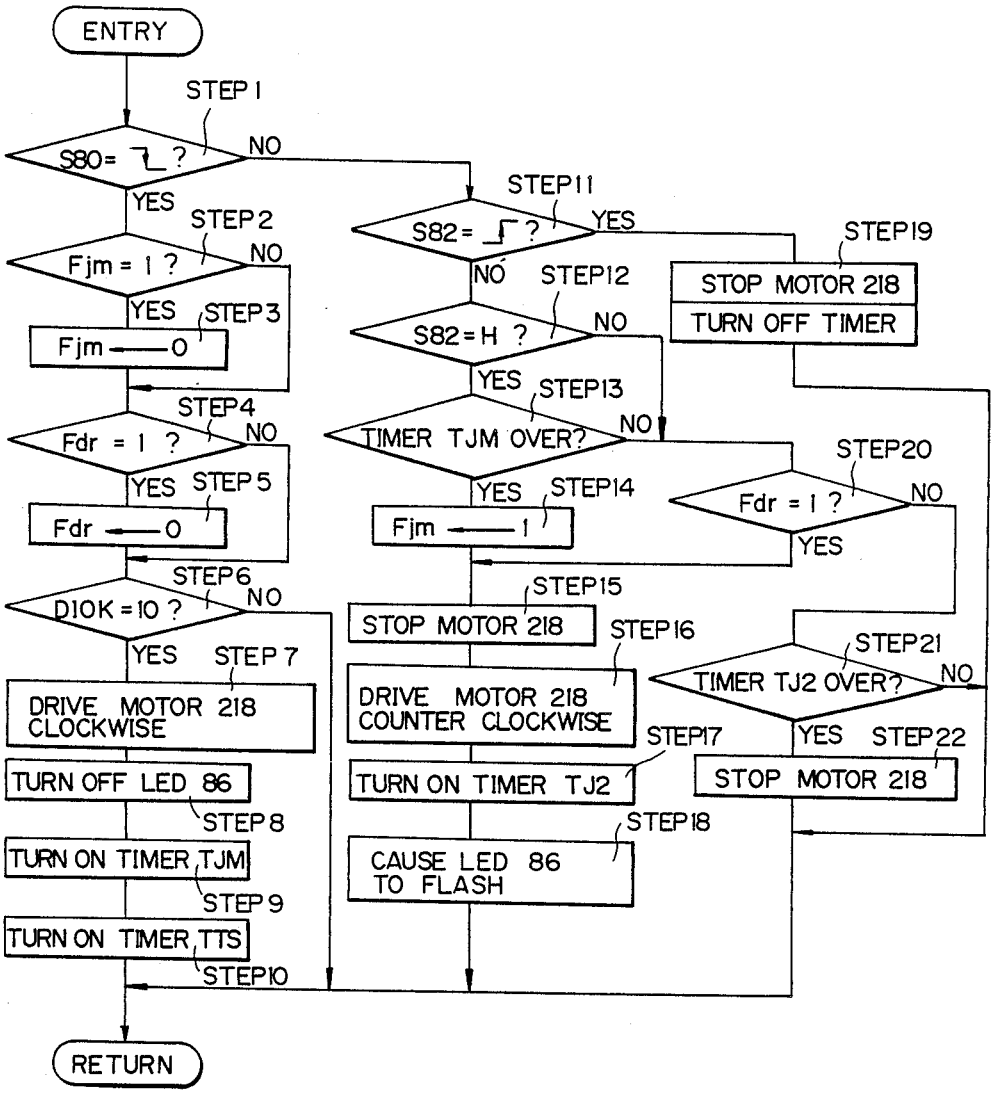
FIGS. 8, 9, 10A, 10B and 11 are flowcharts demonstrating specific operations of the main control unit of the control system which is shown in FIG. 6.

A reference will be made to FIG. 7 for describing the interchange of data between the main control unit 162 of the copier 10 and the main control unit 214 of menu sheet reader 62. When the copier 10 is brought to a ready state, it delivers a READ signal to the menu sheet reader 62. In response, the menu sheet reader 62 turns on an indicator for urging a person to insert the menu sheet 66. After the menu sheet 66 has been inserted in the reader 62, the latter reads the former and then turns off the above-mentioned indicator. Subsequently, the reader 62 transmits a DATA PRESENT signal to the copier 10. If the copier 10 received the DATA PRESENT signal is in a ready state, it returns a TRANSMIT signal to the reader 62. In response, the reader 62 sequentially transmits to the copier 10 the data which have been read out of the menu sheet 66. More specifically, every time the reader 62 sends data to the copier 10, the copier 10 returns a TRANSMIT signal to the reader 62 causing the latter to transmit one byte of data to the copier 10. This procedure is repeated for all of the data dread out of the menu sheet 66. As all the data have been transmitted, the reader 62 sends an END-OF-DATA signal to the copier 10. In response to the END-OF-DATA signal, the copier 10 executes predetermined mode set processing and then sends another READ signal to the reader 62. If the menu sheet 66 is inserted in the reader 62 again, the above sequence of steps will be repeated.

When the mode set processing is repeated a plurality of times, the modes selected by the last processing are set in the copier 10. When information is entered on the operation board 102 of the copier 10 after certain modes have been set via the menu sheet reader 62, the modes are altered in response to the inputs on the operation board 102. Conversely, when data are entered on the reader 62 after the copier 10 has been conditioned for certain modes entered on the operation board 102, the modes are altered in response to the data entered on the reader 62. If desired, an arrangement may be made such that either one of the operation board 102 and the reader 62 has priorty over the other with respect to the mode setting, and the priority is changed over by a switch. For example, the arrangement may be such that when the key inputs on the operation board 102 has priority over the data read by the reader 62, mode setting on the menu sheet reader 62 is inhibited except for a standard mode of the copier 10 while, when the reader 62 has priority over the operation board 102, key inputs except for the inputs on the all-clear key 138 and print start switch 140 are inhibited after mode setting on the reader 62.

As the print start switch 140 is pressed, the copier 10 sends a DO NOT READ signal to the menu sheet reader 62 while starting on a copying operation based on the selected operation modes. At this time, the indicator on the reader 62 for urging a person to insert the menu sheet 66 is turned off. Upon completion of the copying operation, the copier 10 sends a READ signal to the reader 162.

In this particular embodiment, the copier 10 sends three different kinds of signals to the menu sheet reader 62, i.e. READ signal, DO NOT READ signal, and READY signal. The READ and DO NOT READ signals are labeled DIOK and are associated with 8-bit codes of 10H and 00H, respectively. The READY signal is labeled DSOK and associated with an 8-bit code of FFH. The signals sent from the menu sheet reader 62 to the copier 10 are shown in Table 1 below.

TABLE 1

| BIT | | | | | | |
|---|---|---|---|---|---|---|
| 7 | 6 | 5 | 4 | 3~0 | DATA | LABEL |
| | | BCD | | 0 | copy number units | DCP 1 |
| | | BCD | | 1 | copy number tens | DCP 2 |
| A3 | B4 | A4 | B5 | 2 | paper size | DSZ |
| 0 | 0.71 | 1.41 | 1 | 3 | magnification | DMN |
| 1 | 1 | 1 | 1 | 4 | two-sided copy | DDC |
| 0 | 0 | STACK | SORT | 5 | sorter function | DST |
| | | | | 6 | spare 1 | DYB 1 |
| | | | | 7 | spare 2 | DYB 2 |
| | | | | 8 | spare 3 | DYB 3 |
| | Fcpr | Fdr | Fjm | 9 | error display | DED |
| | | | | A | user management data | DUK |
| | | | | B | | |
| | | | | C | | |
| | | | | D | | |
| 1 | 1 | 1 | 1 | E | end of data | DEND |
| 1 | 1 | 1 | 1 | F | data present | DIN |

In Table 1, each signal basically has lower four bits which are representative of the identity of data and upper four bits which are representative of the content of data. As shown in Table 1, the units digit and the tens digit of the number of copies are represented respectively by labels DCP1 and DCP2 while the numbers "0" to "9" are individually represented by BCD codes which are included therein. The paper size is represented by a label DSZ, and specific sizes B5, A4, B4 and A3 are individually designated by codes. In this example, "1" is representative of "active" and this is also true with the other codes. Concerning the magnification, while thee kinds of enlargement (1.15, 1.22 and 1.41) and five kinds of reduction (0.93, 0.87, 0.82, 0.71 and 0.64) are available with the copier 10 in addition to 1 magnification, the magnifications available with the menu sheet 66 are assumed to be the 1.14 enlargement and 0.71 reduction only. The two-sided copying function and the sorter function are represented by labels DDC and DST, respectively. The data associated with the sorter mode has a bit for designating a sort mode and a bit for designating a stack mode. Data labeled DED is associated with error display, i.e., bits 4, 5 and 6 are respectively representative of a jam flag, a menu sheet orientation error flag, and a registered/non-registered identity code flag. In the illustrative embodiment, sixteen different identify codes are registered beforehand so that sixteen users or departments may be identified. A signal including 4-bit data which is representative of the identified user is the user management data which is labeled DUK. This data is used by the copier 10 to govern the number of copies produced, for example. Data labeled DEND is indicative of the end of transmission of all of the data, and data labeled DIN is indicative of the insertion of the menu sheet 66 or the appearance of a control code.

A specific operation of the menu sheet reader 62 will be described with reference to FIGS. 8, 9, 10A, 10B and 11. First, the subroutine of FIG. 8 adapted to controllably drive the motor 218 will be described. In a STEP 1, whether or not the positive-going edge of an output signal S80 of the sensor 80 which is representative of the insertion of the menu sheet 66 has been sensed is determined. Specifically, the signal S80 turns from a high level (H) to a low level (L) when the menu sheet 66 is inserted in the inlet 68 of the menu sheet reader 62. If the answer of the STEP 1 is YES, a STEP 2 is executed; if it is NO, the program is transferred to a STEP 11. In the STEP 2, a jam flag Fjm is checked and, if it is in a (logical) ONE, a STEP 3 is executed to clear it. In a STEP 4, a direction flag FDR is checked and, if it is in a ONE, a STEP 5 is executed to clear it to a (logical) ZERO. In a STEP 6, whether or not the copier 10 has sent a READ signal to the reader 62 is determined. If the answer of the STEP 6 is YES, a STEP 7 is executed for starting driving the roller drive motor 218 in the forward or clockwise direction. This causes the menu sheet 66 to be transported from the inlet 68 toward the outlet 70 of the reader 62. In a STEP 8, the LED of the indicator 86 is turned off. In STEPs 9 and 10, timers TJM and TTS respectively are turned on.

In a STEP 11, whether or not the positive-going edge of an output signal S82 of the sensor 82 which is representative of the discharge of the menu sheet 66 has been sensed is determined. Immediately after the start of transport of the menu sheet 66, the operation advances to a STEP 12 and, since the signal S82 has a high level at that time, the STEP 12 is followed by a STEP 13. In the STEP 13, the jam timer TJM is cleared. Usually, the outlet sensor 82 is expected to sense the trailing edge of the menu sheet 66 within a predetermined period of time after the inlet sensor 80 has sensed it and, hence, the signal S82 turns from H to L as determined by the STEP 12 before the time of the timer TJM expires. Then, the STEP 12 is followed by a STEP 20. When the menu sheet 66 jams the transport path inside the reader 62, the outlet sensor 82 will not sense the leading edge of the menu shet 66 even after the lapse of the predetermined period of time and, therefore, the time of the timer TJM will expire as determined by the STEP 13. In this case, the STEP 13 is followed by a STEP 14. In the STEP 14, the jam flag Fjm is set to a ONE and, then, a STEP 15 is executed.

In the STEP 15, the menu sheet transport motor 218 is deenergized; in a STEP 16, the motor 218 begins to be driven in the reverse or counterclockwise direction; in a STEP 17, the timer TJ2 is turned on; and in a STEP 18, the LED of the indicator 86 begins to flash intermittently. More specifically, when a jam is detected, the jam flag 1 is set to a ONE and the menu sheet 66 is transported backward toward the inlet 68. As the STEPs 12, 20 and 21 are sequentially executed causing the time of the timer RJ2 to expire, a STEP 22 is performed for deenergizing the motor 218. If the direction flag Fdr is in a ONE as determined by the STEP 20, the program advances to the STEP 15 to return the menu sheet 66 toward the inlet 68. When the sensor 82 senses the discharge of the menu sheet 66, i.e., the positive-going edge of the signal S82 is detected as determined by the STEP 11, a STEP 19 is executed to deenergize the motor 218 while turning off the timer.

Figure 12:
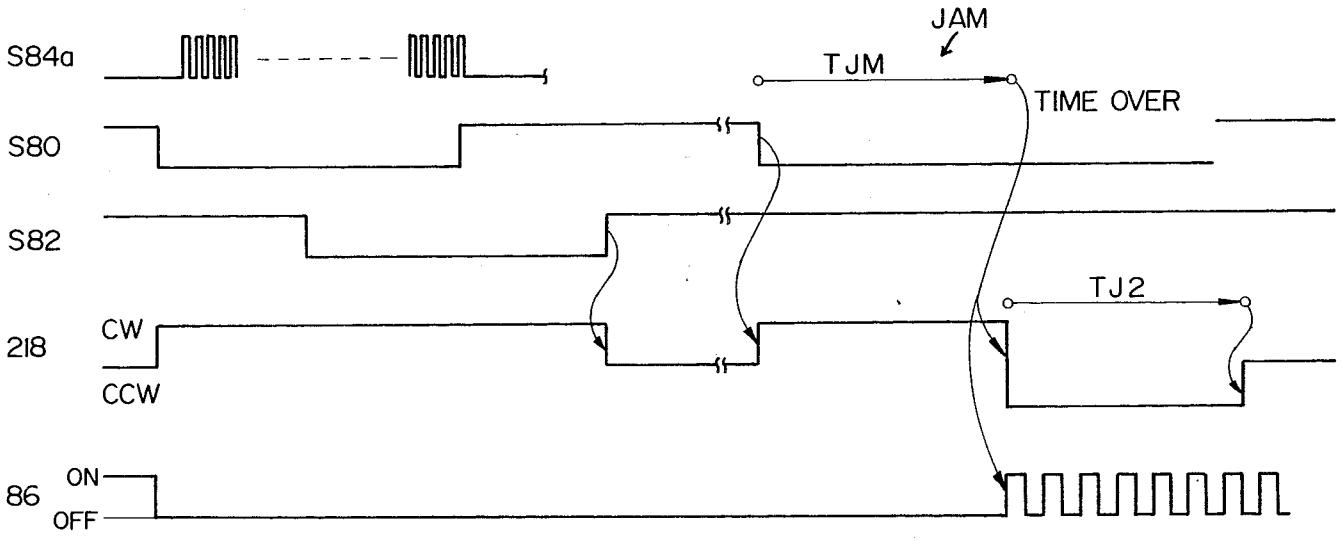
FIG. 12 is a timing chart representative of a specific sheet transporting operation the menu sheet reader.

FIG. 12 shows exemplary operation timings which occur when the menu sheet 66 is transported without any error and those which occur when it has jammed the transport path.

Figure 9:
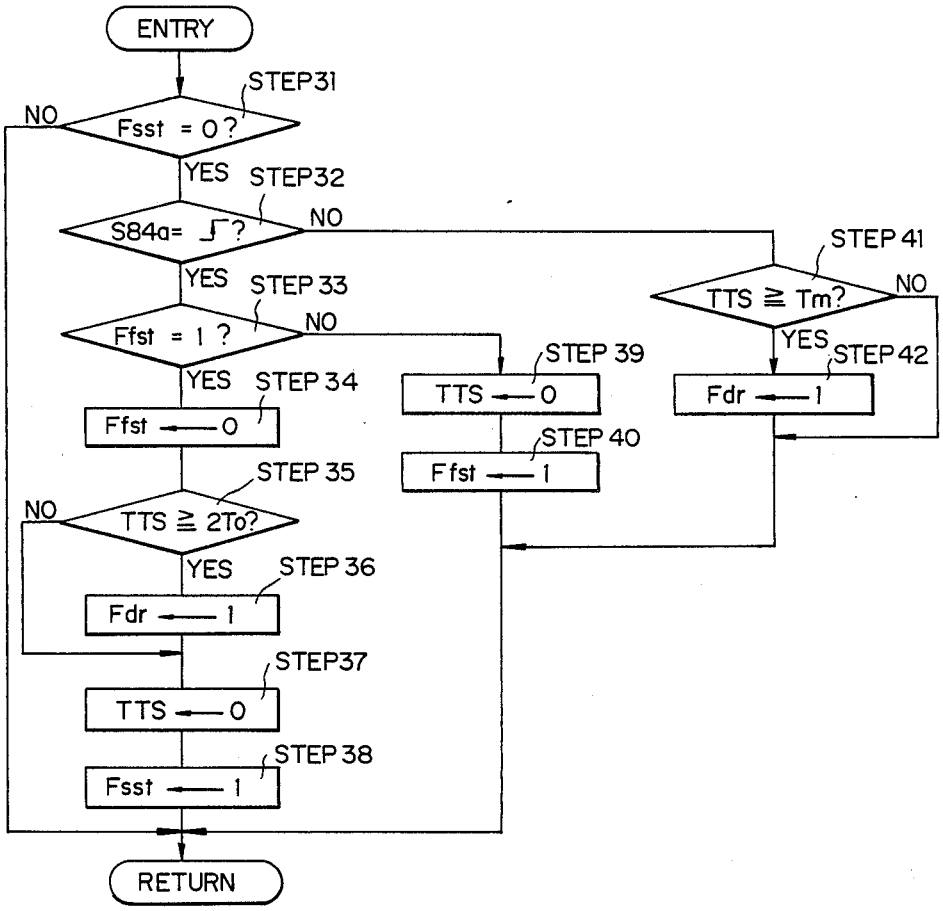

In FIG. 9, there is shown a routine for identifying the position and the direction of insertion of the menu sheet 66. In a STEP 31, the status of a flag Fsst is determined. Immediately after the start of reading of the menu sheet 66, the flag Fsst remains in a ZERO and, therefore, the program advances to a STEP 32. In the STEP 32, whether a timing mark read signal **S84*a* from the sheet read sensor 84*a* has turned from L to H, i.e., whether the sensor 84*a* has sensed the timing mark 90 (smeared portion) provided on the menu sheet 66 is determined. At this stage, however, it is not known if the mark sensed by the sensor 84*a* is the true timing mark 90 or another mark 94, 98 or 100. If the sensor 84*a*** has sensed such a mark as determined by the STEP 32, a STEP 33 is executed for checking the status of a first flag Ffst. Since the flag Ffst is in a ZERO at first, STEPs 39 and 40 are sequentially executed to clear the timer TTS and set the flag Ffst to a ONE. As the flag Ffst is set to a ONE, i.e., when the second black mark (timing mark) is sensed, the STEP 33 is followed by a STEP 34 for clearing the flag Ffst to a ZERO. The STEP 34 is in turn followed by a STEP 35.

In the STEP 35, the content of the timer TTS is compared with a predetermined time 2 To which is slightly shorter than a period of time necessary for the menu sheet 66 to move a distance equal to the pitch of the timing marks 90. Every time the sheet read sensor **84*a* senses a timing mark 90, the timer TTS is cleared. It follows that the value of the timer TTS is approximately equal to To when it is largest. However, when the menu sheet 66 is inserted in the opposite orientation causing the sheet read sensor 84*a* to sense the mark 94 or when the sheet 66 is turned upside down causing the sensor 84*a* to sense the mark 98 or 100, the content of the timer TTS may exceed 2 To. When the timer TTS exceeds 2 To, the program determines that the menu sheet 66 is inserted in the wrong orientation or inserted upside down. Then, a STEP 36 is executed for setting the direction error flag Fdr to a ONE. In a STEP 37, the timer TTS is cleared and, in a STEP 38, the end flag Fsst is set to a ONE. As the end flag Fsst turns from a ZERO to a ONE, the program skips the subsequent steps. If the black marks are sensed at a period which is longer than a predetermined time Tm, the position of the menu sheet 66** may be inaccurate in the lateral direction and, therefore, it is decided that an error has occurred. Specifically, if the content of the timer TTS is greater than Tm as decided in a STEP 41, a STEP 42 is executed for setting the direction error flag Fdr to a ONE. The program may be modified such that for the third and successive timing marks, i.e., when the flag Fsst is a ONE, the detection of incomplete transport due to jamming or similar cause is detected by using the timer TTS.

Figure 10A:
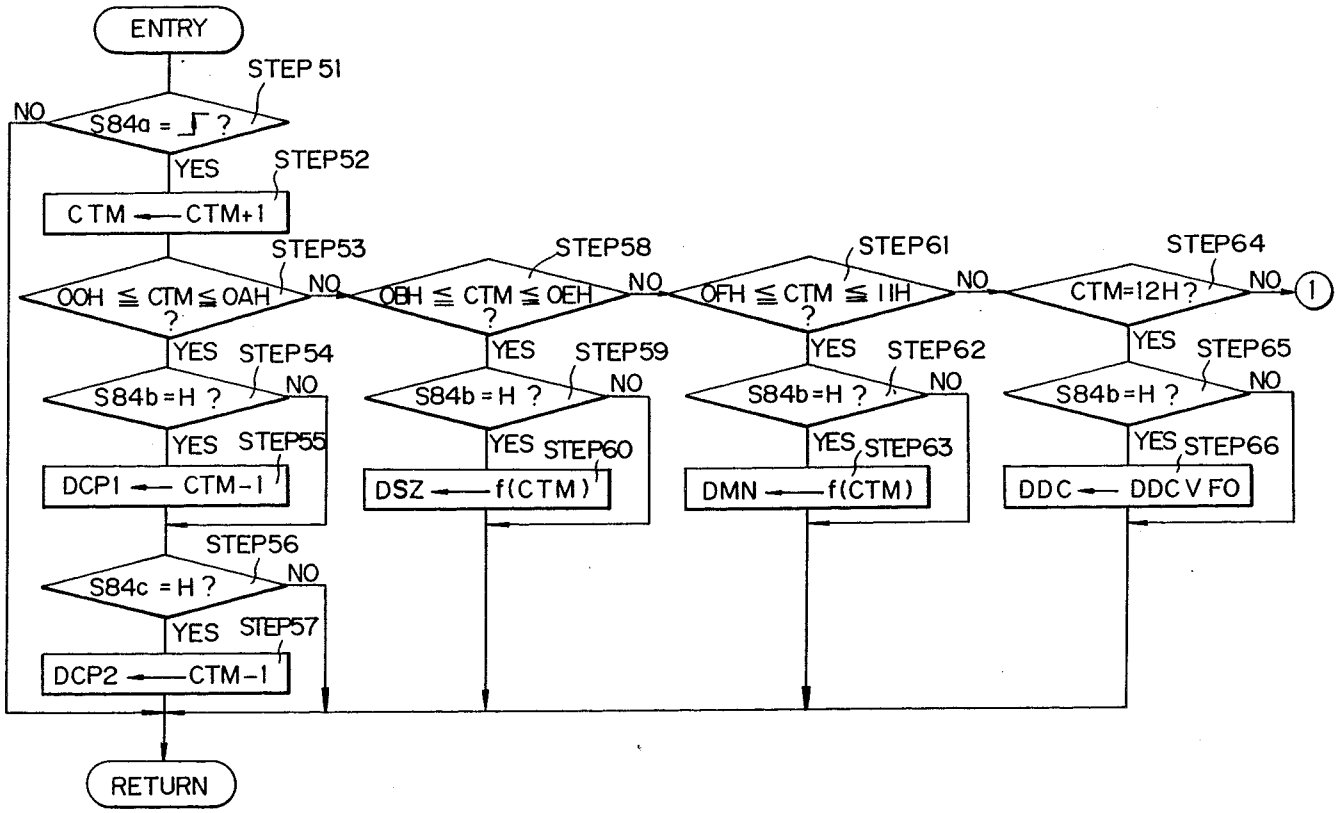
Figure 10B:
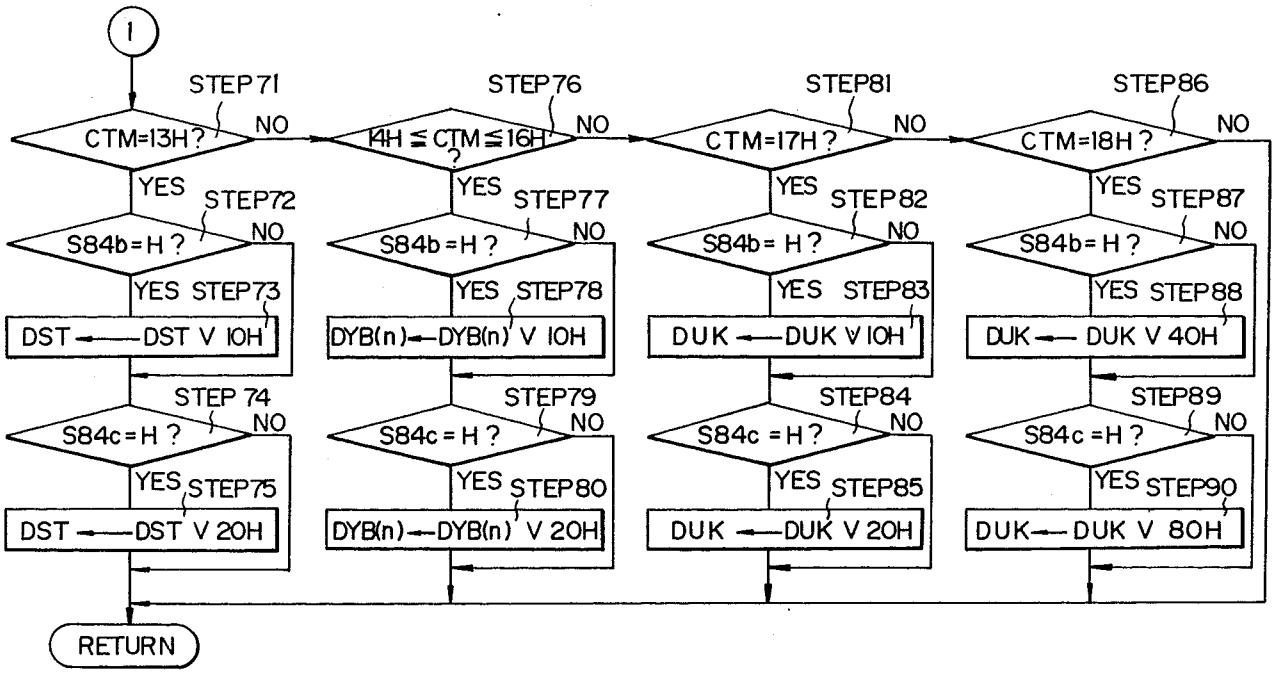

A reference will be made to FIGS. 10A and 10B for describing a subroutine for reading marks which are provided on the menu sheet 66. Briefly, this subroutine is such that the black mark 92 on the menu sheet 66 are read out to generate the data shown in Table 1. In a STEP 51, whether or not the positive-going edge of the output signal 84*a* of the sheet read sensor 84*a* has been detected is determined. The STEP 51 is followed by a STEP 52. More specifically, the STEP 52 and successive steps are repetitively executed every time the sheet read sensor 84*a* senses the timing mark 90. In a STEP 52, a counter CTM is incremented. It is to be noted that this counter CTM is cleared to zero before the menu sheet 66 begins to be read. If the value of the counter CTM lies in the range of 00 H to 0 AH, STEPs 53 and 54 are executed. Specifically, when the data area assigned to the number of copies is to be read, the program advances to the STEP 54 and successive steps. When both of the sheet read sensors 84*b* and 84*c* sense smeared portions of the menu sheet 66, data are individually loaded in the labels DCP1 and DCP2. Likewise, when the value of the counter CTM lies in the range of 0 BH to 0 EH, meaning that the data area assigned to the copy size or paper size is being read, a value associated with the timer CTM (f(CTM) being representative of a function of CTM) is set in the label DSZ when the output signal S84*b* of the sensor 84*b* is in H. Further, when the value of the counter CTM lies in the range of 0 FH to 11 H, meaning that the data area assigned to magnification is being read, a value associated with the content of the timer CTM is set in the label DMN when the signal 84*b* is in H. The other data areas are processed in the same manner as shown in FIGS. 10A and 10B, producing the data as shown in Table 1.

Figure 11:
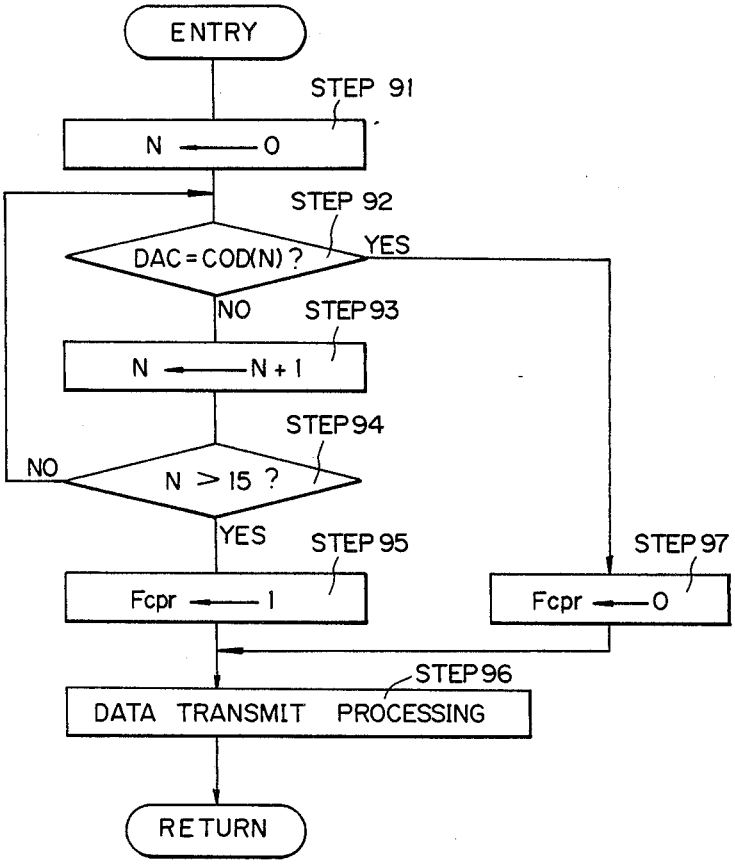

As the data provided on the menu sheet 66 have been fully read out, a sequence of steps for identifying the user ID code provided on the menu sheet 66 is executed as shown in FIG. 11. In a STEP 92, a 10-bit ID code DAC formed in the identity area of the menu sheet 66 is compared with sixteen different codes COD (0 to 15) which are registered in the menu sheet reader 62 beforehand. If the sensed ID code is identical with any of the registered codes COD, the STEP 92 is followed by a STEP 97 for clearing a copy inhibit flag Ecpr to a ZERO. If the sensed ID codes is not identical with any of such codes COD, a STEP 95 is executed for setting the copy inhibit flag Fcpr to a ONE. Upon identification of the ID code, i.e., when the STEP 95 or 97 has been completed, a STEP 96 is executed to transmit the data read out of the menu sheet 66, i.e., the data shown in Table 1 to the copier 10 according to the previously stated procedure.

Figure 13:
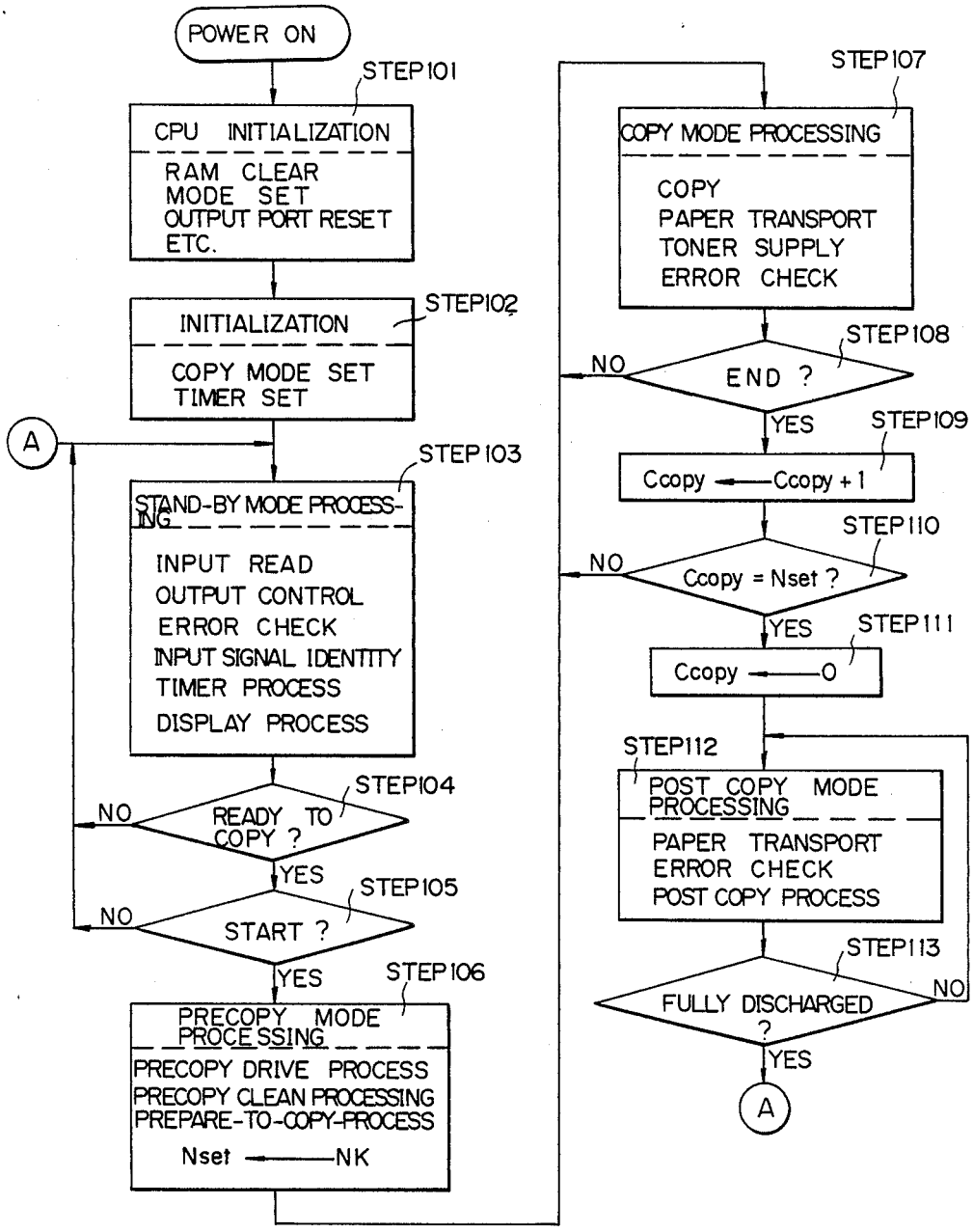
FIGS. 13 to 19 are flowcharts each showing a part of the operation of the main control unit of the control system which is shown in FIG. 5.

The main control unit 162 shown in FIG. 5 is operated as follows. FIG. 13 outlines the general operation of the main control unit 162. The basic procedure shown in FIG. 13 is similar to that of an ordinary copier and, therefore, details thereof will not be described.

While the copier 10 is in a stand-by condition, STEPs 103, 104 and 105 are sequentially and repetitively executed. In this condition, data are interchanged between the copier 10 and the menu sheet reader 62. A part of the processing included in the STEP 103, 104 and 105 of FIG. 13 is shown in FIGS. 14, 15, 16, 17, 18 and 19.

Figure 14:
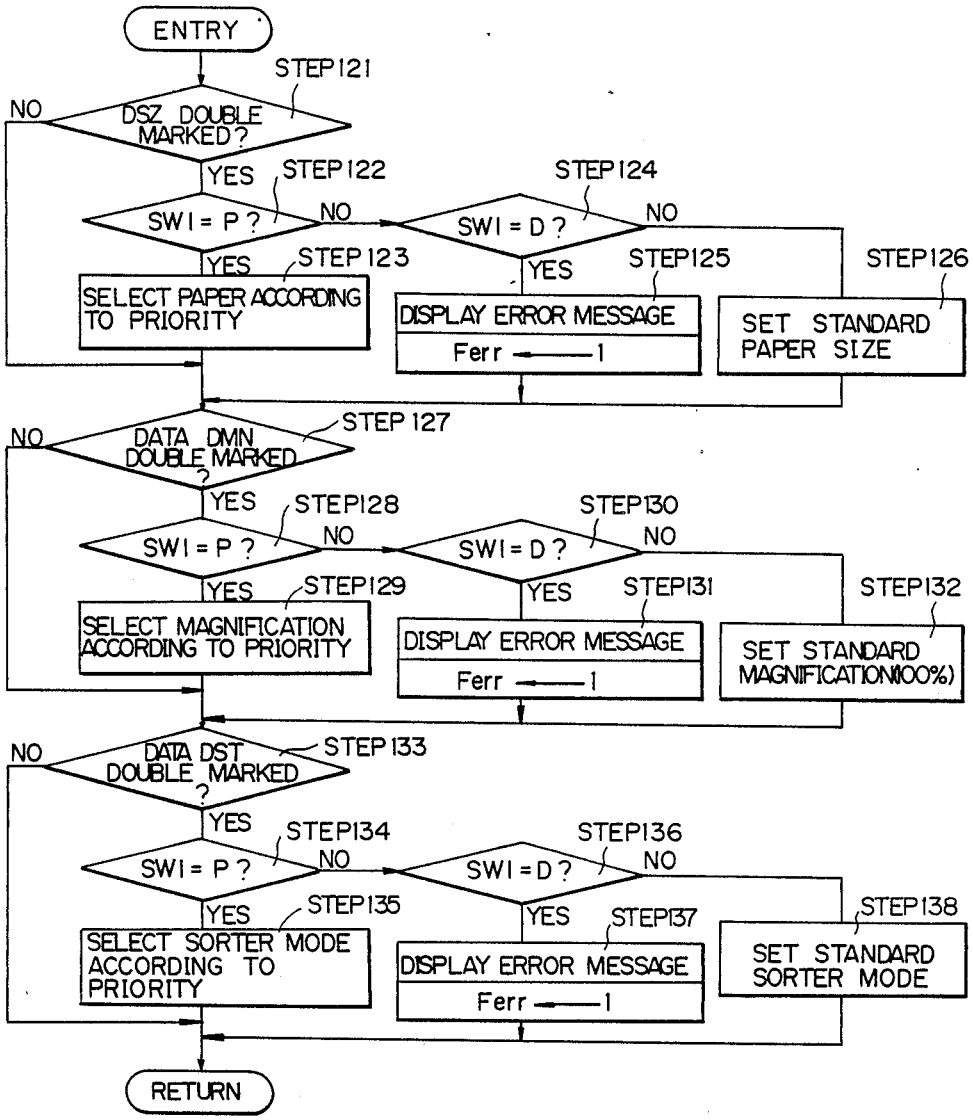

FIG. 14 shows a subroutine for identifying erroneous marking in distinction from ordimary marking. As shown, in a STEP 121, whether or not data DSZ (see Table 1) sent from the menu sheet reader 62 to the copier 10 is free from errors is determined. The data DSZ is associated with the size of paper sheets and is expected to be any one of A3, B4, A4 and B5. It may occur, however, that one inadvertently smears a plurality of blanks on the menu sheet 66 which are associated with the paper size. When this kind of occurrence is detected, a STEP 122 is executed. When the mode switch 204 assumes a position "P" for specifying a priority order, a STEP 123 is executed for correcting the data according to the selected priority order. For example, assuming that marks individually designating the sizes A3 and A4 are written together on the menu sheet 66, and that the priority order of the paper sizes is A4, B5, B4 and A3, and that A4 is selected because it has priority over A3. When the mode switch SW1 assumes a position D for displaying an error, a STEP 125 is executed to cause the message display 148*a* of the operation board 148 to display a message such as "MULTIPLE DATA" while setting the error flag Ferr to a ONE. When the mode switch SW1 assumes a position "N" for selecting a standard mode, a STEP 126 is performed to restore the paper size selection mode to a predetermined standard condition (a condition immediately after the turn-on of the power switch or immediately after all-clear).

A STEP 127 is executed to see if data DMN (see FIG. 1) fed from the menu sheet reader 66 to the copier 10 is unusual. The data DMN is associated with the magnification and is expected to show either 0.71 or 0.41, but there is a fear that both of such different magnifications are inadvertently specified on the menu sheet 66. When such an occurrence is detected by the STEP 127, the program advances to a STEP 128. In this case, too, either one of the magnifications will be selected according to a priority order if the mode switch SW1 assumes the position "P", the error will be displayed if the switch SW1 assumes the position "D", and the magnification is restore to standard if the switch SW1 assumes the position "N". Likewise, when multiple data DST are found by a STEP 133, a STEP 134 and successive steps are executed; the sorter function is selected according to a priority order if the mode switch SW1 assumes the position "P", the error is displayed if the switch SW1 assumes the position "D", and the sorter function is restored to standard if the position of the switch SW1 is "N".

Figure 15:
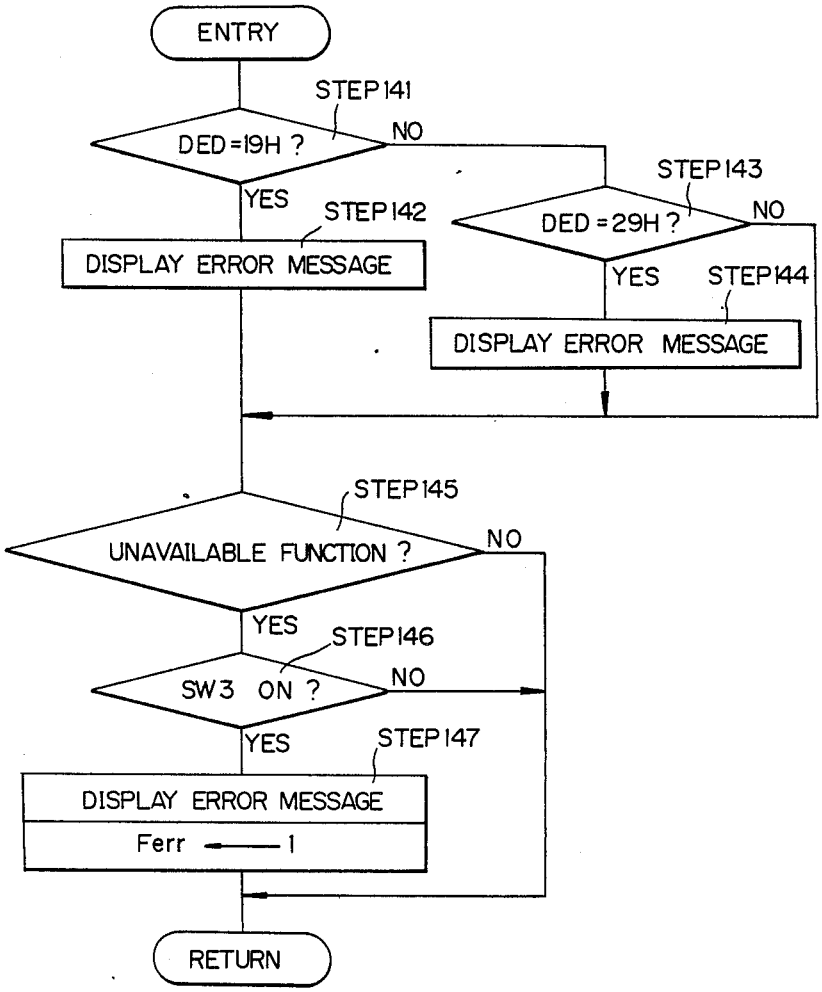

Hereinafter will be described error processing with reference to FIG. 15. In STEPS 141 and 143, the menu sheet reader 62 is checked as to errors by referencing received data DED. Specifically, in the STEP 141, whether or not the data DED is 19 H, i.e., whether or not the jam flag Fjm at the bit 4 has been set is determined. If the answer is YES, a STEP 142 is executed for displaying a message such as "REWRITE MENU SHEET" on the message display 148*a*. In the STEP 143, whether or not the data DED is 29 H, i.e., whether or not the direction error flag Fdr at the bit 5 has been set is determined. If the answer is Yes, a STEP 144 is executed for providing a message such as "WRONG ORIENTATION" on the message display 148*a*. A STEP 145 is adapted to see if a mode which should not be specified has been entered, e.g., if a data area for selecting a stapler mode has been marked on the menu sheet 66 with data being set in DYB1. If the answer of the STEP 145 is YES, the operation advances to a STEP 146. If the mode switch SW3 connected to the main control unit 162 is OFF as determined by the STEP 146, the above-mentioned data is neglected; if the switch SW3 is ON, a STEP 147 is executed for displaying a message such as "STAPLE FUNCTION UNAVAILABLE" on the message display 148*a* while setting the error flag Ferr to a ONE.

Figure 16:
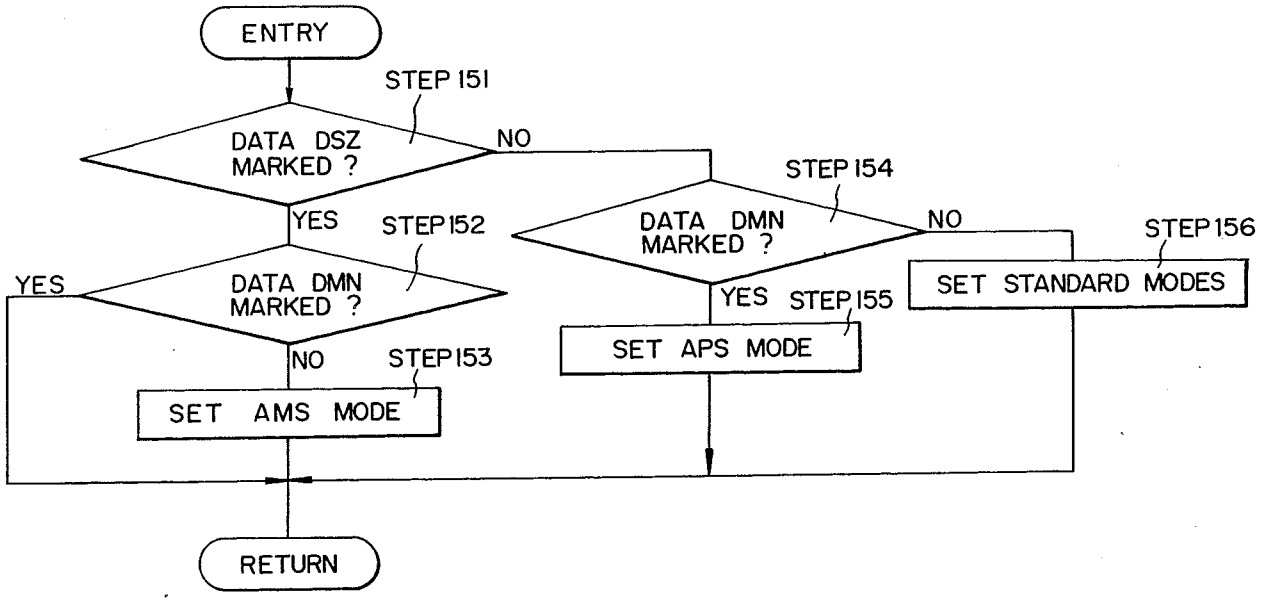

FIG. 16 shows mark omission processing. Generally, to adjust a document and a paper sheet with respect to magnification, it is necessary that the size of paper sheets be selected in matching relation to the size of an image to be recorded. Should such selection be erroneous or practically forgotten, the paper sheet would fail to accommodate the image or remain blank over a substantial area thereof. The processing of FIG. 16 is successful in eliminating such occurrences. Specifically, in a STEP 151, data DSZ is referenced to see if any paper size has been specified. If the answer is YES, the STEP 151 is followed by a STEP 152 wherein any magnification has been selected is determined by referencing data DMN. If a paper size has been selected and a magnification has been omitted, an AMS mode is set up. In the AMS mode, the copier 10 sets up a magnification automatically in matching relation to the paper document size and paper size before starting on a copying operation. The document size is sensed by the ADF 14. The widthwise size of a paper sheet is sensed by multiple optical sensors, while the longitudinal size of the same is determined in terms of the time at which the paper sheet reaches an exclusive sensor. Hence, even when a magnification is not specified on the menu sheet 66, an adequate magnification is selected automatically.

If no data DSZ (paper size) has been selected as determined by the STEP 151, a STEP 154 is executed to see if a magnification (DMN) has been specified. If any magnification has been specified and no paper size has been specified, the program advances to a STEP 155 for loading the copier 10 with an APS mode. In the APS mode, the copier 10 detects the document size before a copying operation, determines an adequate paper size on the basis of the document size and the selected magnification, and selects one of the cassettes which is loaded with paper sheets of the determined size automatically. When both of the data DSZ and DMN are omitted on the menu sheet 66, a STEP 156 is executed for setting a standard magnification and a standard paper size (e.g. 1 magnification and size A4).

Figure 17:
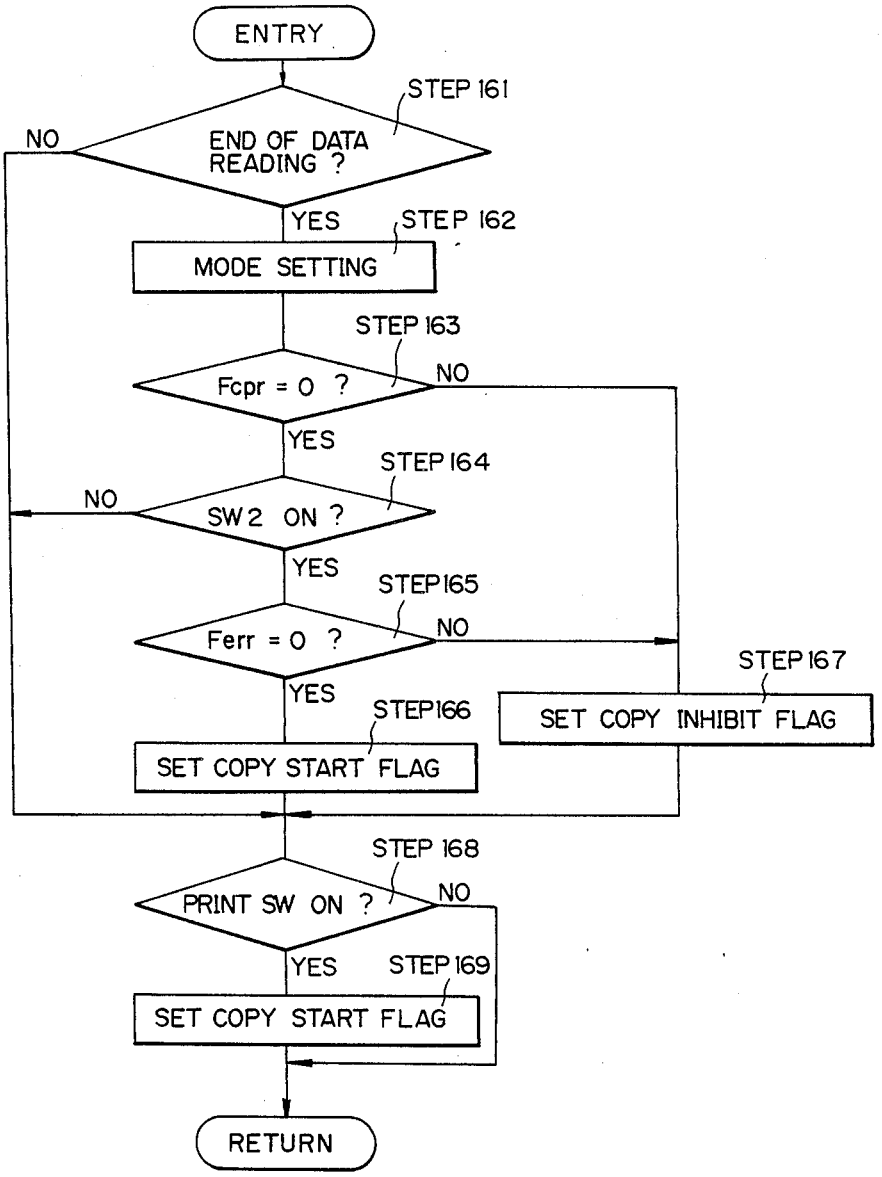

FIG. 17 shows an automatic start subroutine. Usually, the copier 10 begins a copying operation when the print start key 140 provided on the operation board 102 is pressed. In this particular embodiment, it is also possible for the copier 10 to start a copying operation automatically when modes are fully set up based on the data from the menu sheet reader 62. Specifically, in a STEP 161 shown in FIG. 17, whether the reader 62 has sent all of the data and then the END-OF-DATA signal is determined. If the main control unit 162 has received the END-OF-DATA signal, a STEP 162 is executed to set various modes as indicated by the received data. In the next STEP 163, the flag Fcpr is checked. If the flag Fcpr is a ZERO, the program advances to a STEP 164; if it is a ONE, meaning that the ID code marked on the menu sheet 6 is not a registered code, a STEP 167 is executed to set the copy inhibit flag. In the STEP 164, the status of the mode switch SW2 connected to the main control unit 162 is checked. If it is ON, a STEP 165 is performed for checking the error flag Ferr. If the error flag Ferr is a ZERO, meaning that no error has occurred, the operation advances to a STEP 166 to set a copy start flag. More specifically, on condition that various modes have been selected based on the data from the reader 62, that the ID code is identical with any one of registered codes, that the mode switch SW2 is ON, and that other errors are absent, the copy start flag is set to start a copying operation despite that the print start switch 140 is not pressed.

Figure 18:
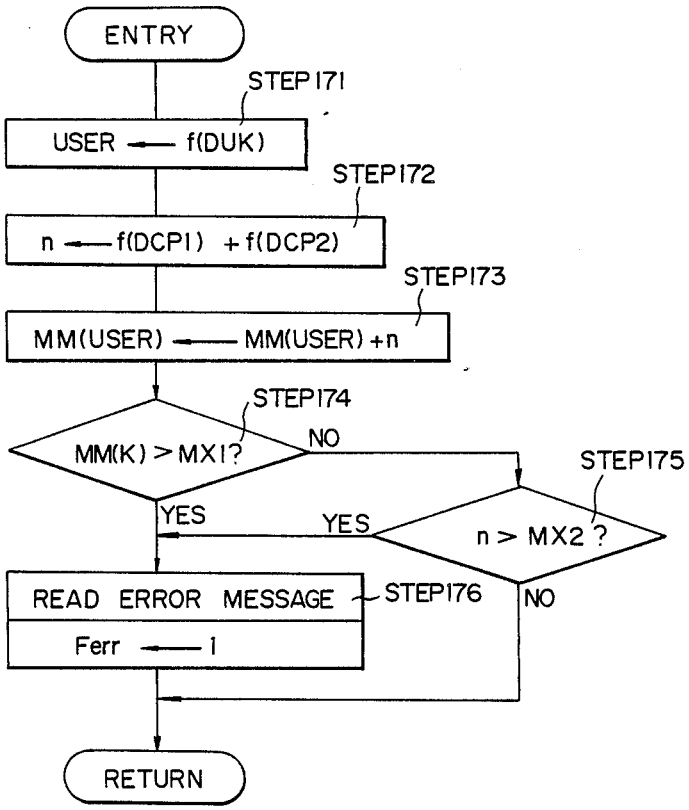

FIG. 18 shows a user management subroutine. In a STEP 171, a user number USER is generated in response to data DUK fed from the menu sheet reader 62, i.e., upper four bits of the data DUK which are representative of one of sixteen user numbers are stored in USER. In a STEP 172, a specified number of copies which is the function of data DCP1 and DCP2 is generated and stored in n. In a STEP 173, the program accesses, among integrating memories MM each being assigned to respective one of users, an integrating memory MM assigned to the identified user so as to add the number of copies n specified this time. In a STEP 174, the content of the memory updated by the STEP 173 is compared with the maximum allowable number MX1 allocated to each user. In the STEP 174, K is the same as USER with respect to the content. When MM (K) is greater than MX1, a message such as "EXCESS" is displayed on the display 148*a* and, at the same time, the error flag Ferr is set to a ONE. In the STEP 175, the number of copies n entered this time is compared with the maximum allowable number MX2 allocated to each user and, if n is greater than MX2, the program advances to a STEP 176 for displaying an error message while setting the error flag Ferr.

Figure 19:
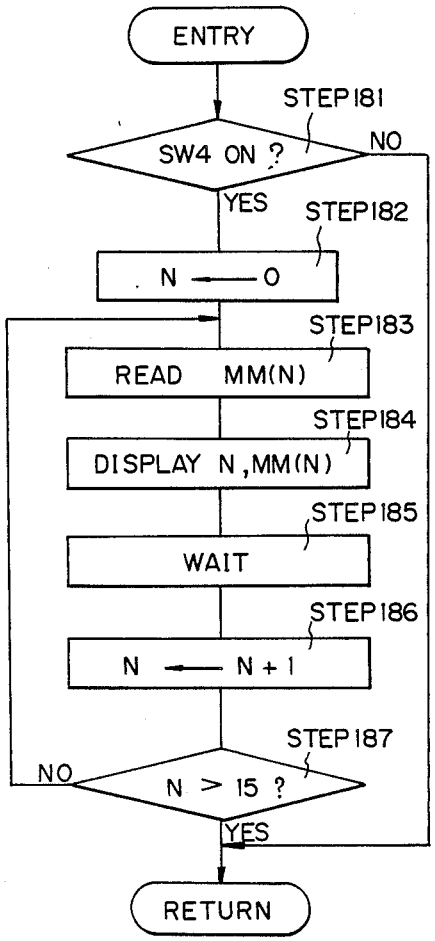

Further, FIG. 19 shows a management data output subroutine. In a STEP 181, the status of the mode switch SW4 connected to the main control unit 162 is determined. When the switch SW4 is turned on, a STEP 182 and successive steps are executed. In the STEP 182, a counter N is cleared to zero and, in a STEP 183, the content of the integrating memory MM (N) assigned to a user who is associated with the counter N is read. In a STEP 184, the content of the counter N and the value read by the STEP 183 are displayed simultaneously on the operation board 102. Then, the program waits a certain period of time for allowing the operator to recognize the display. In a STEP 186, the counter N is incremented. Such a procedure is repeated until data associated with all of the sixteen users have been displayed. That is, by turning on the switch SW4, it is possible to show the total number of produced copies user by user.

In summary, it will be seen that the present invention allows an office machine to be conditioned for desired operation modes automatically only if a simple menu sheet is marked then read by a menu sheet reader. Even when the menu sheet jams the menu sheet reader, it can be handled with ease.

Various modifications will become possible for those skilled in the art after receiving the teachings of the present disclosure without departing from the scope thereof.

What is claimed is:

1. An apparatus for setting operational conditions of an office machine which performs a recording operation by using a menu sheet having a predetermined format and provided with an area for writing information, comprising:

reading means for reading the information written in said area of said menu sheet; and mode setting means for setting operational modes of said office machine on the basis of the information read by said reading means and for ignoring any information read by said reading means which is representative of an operation condition which is not available with said office machine and further for causing said machine to start a recording operation automatically when the operational conditions are fully set up.

2. An apparatus as claimed in claim 1, further comprising transport means for transporting the menu sheet such that said menu sheet moves relative to said reading means.

3. An apparatus as claimes in claim 2, further comprising transport condition sensing means for sensing a condition in which the menu sheet is transported by said transport means.

4. An apparatus as claimed in claim 3, further comprising control means for monitoring the condition of sheet transport being sensed by said transport condition sensing means and, when an error is detected, reversing a direction of transport of the menu sheet by said transport means.

5. An apparatus as claimed in claim 3, further comprising alerting means for alerting an operator to an unusual condition of sheet transport which is sensed by said transport condition sensing means.

6. An apparatus as claimed in claim 5, further comprising control means for monitoring the condition of sheet transport and, when an error is detected, energizing said alerting means.

7. An apparatus as claimed in claim 3, further comprising an identification mark provided on the menu sheet and representative of at least one of a direction and a position in which said menu sheet is to be transported, said transport condition sensing means sensing the transport condition of the menu sheet by sensing said identification mark.

8. An apparatus as claimed in claim 7, further comprising alerting means for alerting an operator to an unusual condition of sheet transport which is sensed by said transport condition sensing means.

9. An apparatus as claimed in claim 8, further comprising control means for monitoring the condition of sheet transport and, when an error is detected, energizing said alerting means.

10. An apparatus as claimed in claim 1, wherein, when the information written on the menu sheet include a plurality of operational conditions associated with a single functional item, said mode setting means selects one of said plurality of operational conditions automatically according to a predetermined priority order and sets up said one operational condition as an adequate operational condition.

11. An apparatus as claimed in claim 1, further comprising alerting means for alerting an operator to an error occurred in setting of the operational conditions of said office machine.

12. An apparatus as claimed in claim 11, wherein, when the information written on the menu sheet include a plurality of operational conditions associated with a single functional item, said mode setting means energizes said alerting means and either interrupts setting of operational conditions of said office machine or inhibits said office machine from being started.

13. An apparatus as claimed in claim 1, wherein, when the information written on the menu sheet include a plurality of operational conditions associated with a single operational item, said mode setting means sets up a predetermined standard operational condition associated with said single functional item as an adequate operational condition.

14. An apparatus as claimed in claim 1, wherein, when the information read by said reading means include an operational condition which is not available with said office machine, said mode setting means in addition to ignoring said information also notifies an operator of an error.

15. An apparatus as claimed in claim 1, wherein said office machine comprises document size identifying means for identifying a size of a document carrying an image to be recorded thereon, and magnification adjusting means for adjusting magnification with respect to a document size and a recording size on a paper sheet, said mode setting means setting a magnification automatically on the basis of a document size identified by said document size identifying means and paper sheet selection information when the information written on the menu sheet include information associated with selection of paper sheets and do not include information associated with selection of a magnification.

* * * * *